US005247781A

United States Patent [19]

Runge

[11] Patent Number: 5,247,781

[45] Date of Patent: Sep. 28, 1993

[54] IN-LINE APPLICATION OF CLOSURE TO PACKAGING FILM

[75] Inventor: Heinz F. Runge, Niles, Ill.

[73] Assignee: Kraft General Foods, Inc., Northfield, Ill.

[21] Appl. No.: 741,959

[22] Filed: Aug. 8, 1991

[51] Int. Cl.[5] ..... B65B 9/06; B65B 61/18

[52] U.S. Cl. ..... 53/412; 53/133.4; 53/139.2; 53/450; 53/550; 493/213

[58] Field of Search ..... 53/133.4, 139.2, 389.4, 53/410, 412, 373.8, 375.3, 450, 550; 156/66, 309.9; 493/212, 213, 215, 248, 254, 381, 927, 929

[56] References Cited

U.S. PATENT DOCUMENTS

| | | | |
|---|---|---|---|
| 3,274,746 | 9/1966 | James et al. | 53/22 |
| 3,381,592 | 5/1968 | Ravel | 93/8 |
| 3,532,571 | 10/1970 | Ausnit | 156/91 |
| 3,784,432 | 1/1974 | Noguchi | 156/244 |
| 3,787,269 | 1/1974 | Noguchi | 156/498 |
| 3,904,468 | 9/1975 | Noguchi | 156/244 |
| 3,932,257 | 1/1976 | Noguchi | 156/497 |
| 4,372,793 | 2/1983 | Herz | 156/66 |
| 4,498,939 | 2/1985 | Johnson | 156/66 |
| 4,589,145 | 5/1986 | Van Erden et al. | 383/5 |
| 4,601,694 | 7/1986 | Ausnit | 493/381 |
| 4,625,496 | 12/1986 | Ausnit | 53/451 |
| 4,663,915 | 5/1987 | Van Erden et al. | 53/450 |
| 4,704,842 | 11/1987 | Boeckmann et al. | 53/350 |
| 4,709,533 | 12/1987 | Ausnit | 53/451 |
| 4,745,731 | 5/1988 | Talbott et al. | 53/451 |
| 4,812,074 | 3/1989 | Ausnit et al. | 493/381 X |
| 4,835,835 | 6/1989 | Gould | 156/66 X |
| 4,876,842 | 10/1989 | Ausnit | 53/410 |
| 4,894,975 | 1/1990 | Ausnit . | |
| 4,941,307 | 7/1990 | Wojcik . | |
| 4,957,571 | 9/1990 | Cipolla | 156/66 |
| 4,970,126 | 12/1988 | Boeckmann . | |
| 5,047,002 | 9/1991 | Zieke et al. | 156/66 X |

FOREIGN PATENT DOCUMENTS 0023817 2/1981 European Pat. Off. .

OTHER PUBLICATIONS

European Search Report, Jan. 8, 1993 (2 pages).

*Primary Examiner*—John Sipos
*Assistant Examiner*—Linda B. Johnson
*Attorney, Agent, or Firm*—Fitch, Even, Tabin & Flannery

[57] ABSTRACT

A method and apparatus for applying a pair of continuous narrow interengageable strips of reclosable fastener material to a web of film material in line with horizontal form, fill and seal apparatus to provide a reclosable package. The fastener material is secured within a longitudinal fold in the web of package film material, and the web then proceeds directly into a form, fill, seal machine in which the web is oriented horizontally, and the product is placed on the web. The web is then wrapped upward around both sides of the product to bring the edges together to form a longitudinal fin seal, and subsequently the ends of the package are sealed by transverse sealing means, and the ends of the package are cut from the web to separate the finished package from the preceding and succeeding packages 17 Claims, 8 Drawing Sheets 130
128
128
122
124
120
14
155
118
138
136
134
114
132
106
104
102
90
24
26
16
3
3
12
50
54
18
49
48
43
46
44
62
58
88
40
10
36
20
26
24
122
16
18

IN-LINE APPLICATION OF CLOSURE TO PACKAGING FILM

BACKGROUND OF THE INVENTION

The invention relates generally to packaging, and more particularly to forming, filling and sealing of reclosable packaging.

For certain food products, efficiency in packaging and acceptable shelf life can be obtained by hermetically sealing the product in a package in a form/fill/seal (FFS) operation. One prior art FFS operation that has been used commercially for products such as blocks of cheese involves orienting a web of laminated polymeric material horizontally, placing product on the web, wrapping the web upward around both sides of the product to bring the edges together to form a longitudinal fin seal, and subsequently sealing the ends and cutting the finished package from the web. Gas flush techniques are employed to eliminate oxygen from the package interior. Such an operation is illustrated in U.S. Pat. No 3,274,746.

To provide reclosability for packages produced according to the above method, a continuous narrow strip of zipper material may be secured within a continuous longitudinal fold in the web in a roll-to-roll operation, prior to use of the web in the FFS operation. A form-/fill/seal operation employing a roll of film with a pre-applied zipper secured within a longitudinal fold in the web is illustrated in U.S. Pat. Nos. 4,589,145 and 4,663,915. One shortcoming of this method is that it is somewhat inefficient in requiring two separate operations to provide the finished package. Also, the roll of package material becomes rather bulky and unwieldy after attachment of the zipper, and is lopsided due to the accumulation of successive layers of zipper material on one side of the roll. This may limit the speed of the FFS apparatus, and further may require more frequent replacement of the rolls of stock than in FFS operations where zippers are not used. There is a need for a more efficient method of providing reclosable packaging in horizontal FFS operations.

SUMMARY OF THE INVENTION

The invention provides a method and apparatus for applying a pair of continuous narrow interengageable strips of reclosable fastener material to a web of package material in line with horizontal FFS apparatus to provide a reclosable package. The fastener material is secured within a longitudinal fold in the web of package material, and the web then proceeds directly into a FFS machine in which the web is oriented horizontally, and the product is placed on the web. The web is then wrapped upward around both sides of the product to bring the edges together to form a longitudinal fin seal, and subsequently the ends of the package are sealed by transverse sealing means, and the ends of the package are cut from the web to separate the finished package from the preceding and succeeding packages.

One consideration in providing for in-line attachment of fastener material to a web of film material is the compactness of the apparatus. The apparatus for attaching the fastener material is preferably adapted for retrofit installation in combination with existing form, fill, seal equipment, without unduly increasing the space requirements of the combined apparatus. To this end, the apparatus for attaching the fastener material provides a two-level operation, wherein the components for attaching the fastener profiles to the film are disposed at a lower level, with longitudinal folding of the web taking place thereabove, at the same elevation as the surface of the existing equipment which supports the film web.

Another problem which is addressed by the method and apparatus of the invention is the control or elimination of wrinkling of the web. Wrinkles may interfere with the sealing process to the extent of destroying hermeticity. Means are provided in the method and apparatus of the invention to maintain the film in substantially smooth, unwrinkled configuration. Further aspects of the invention are disclosed below.

DETAILED DESCRIPTION OF PREFERRED EMBODIMENTS

Figure 1:
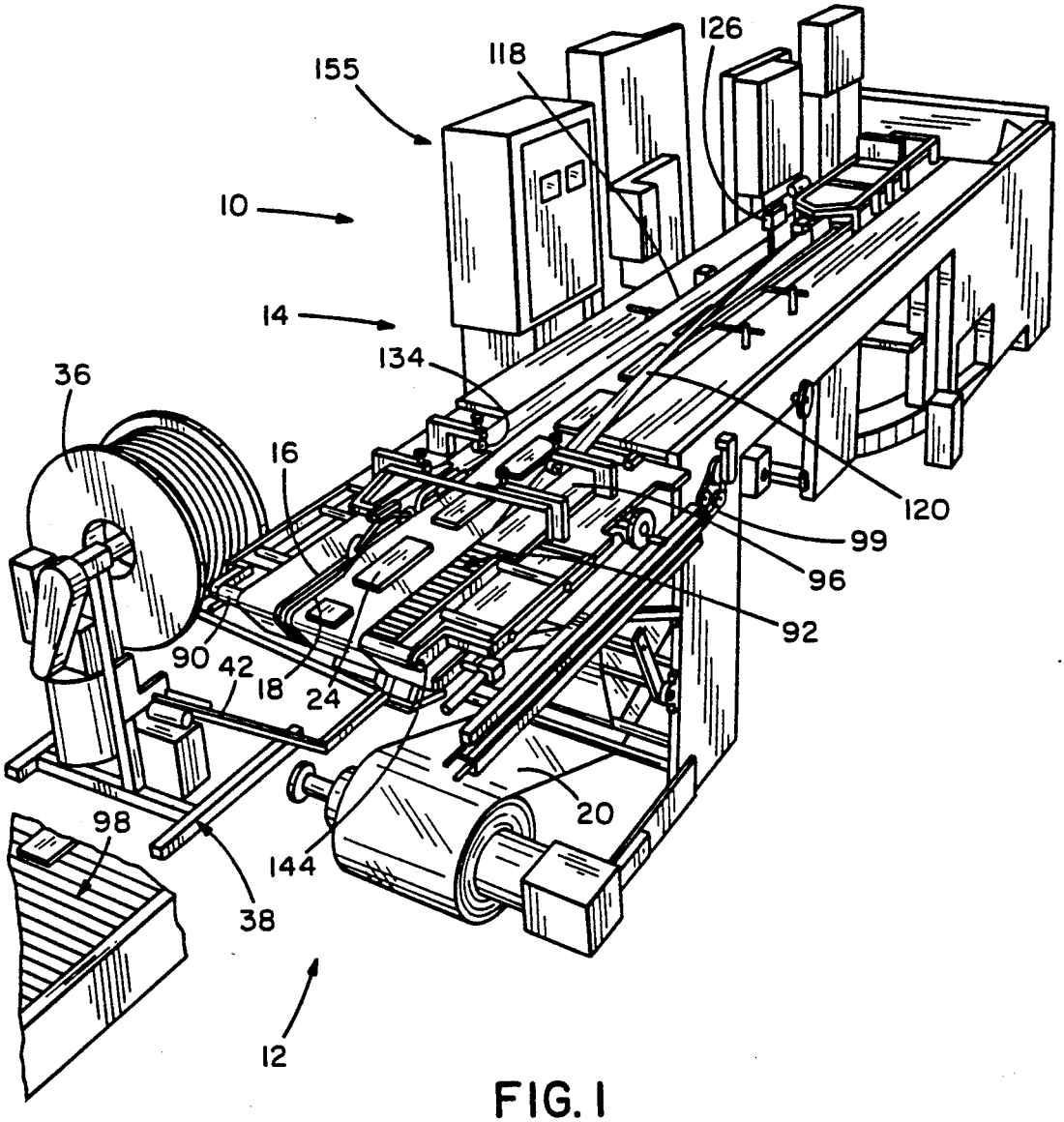
FIG. 1 is a perspective view of apparatus in accordance with the invention.

The invention is preferably embodied in a method and apparatus for forming, filling and sealing reclosable packaging.

The preferred apparatus 10 generally comprises apparatus 12 for joining a pair of continuous narrow strips 6 and 18 of reclosable fastener material to a web of pouch material 20 and forming a longitudinal fold 22 in the film to contain the attached fastener strips, and contiguous apparatus 14 for wrapping the film about a product 24 and sealing and cutting the film to produce the finished package or pouch 26.

The pouch material preferably comprises a laminated polymeric film having an ethylene vinyl acetate copolymer coating on its inner surface. The coating facilitates heat sealing of the package, and particularly facilitates achievement of hermeticity by filling gaps or imperfections in seal areas during sealing. The package material is supplied in the form of a roll 28 supported on a rotatable reel 30 which has a horizontal axis oriented perpendicular to the direction of web travel through the apparatus. The web 20 comprises a series of blanks preprinted with desired labeling and instructional text to inform the purchaser of the steps required for opening and reclosing of the pouch, repeated at regular intervals corresponding to the length of the blank. In one embodiment, the blank length is approximately 12 in.

The fastener strips 16 and 18 have complementary continuous zipper profiles thereon. Each of the strips is an integral, one-piece extrusion having on one side a substantially flat, smooth surface 28 for attachment to the package material, and on the opposite side a zipper profile 30. Means may be provided alongside the zipper profile to facilitate manual frictional engagement of the strip and thereby facilitate separation of the zipper profiles 30 by the consumer in opening the finished pouch. Such means may take the form of longitudinal beads or grooves.

The strips 16 and 18 are preferably made of a flexible, resilient polymeric material, such as polyethylene. To facilitate sealing of the strips to the package material, and to facilitate maintenance of hermeticity at the intersections of the ends of the zipper strips with the cross-seals in the finished package, the zipper strips or portions thereof may be coated with ethylene vinyl acetate. In other embodiments of the invention, each of the strips may have a hot melt adhesive applied to the surface 28 opposite the zipper profiles, or the fastener strips may be uncoated, with adhesion provided solely by an ethylene vinyl acetate coating on the package material.

Prior to use, the fastener strips 16 and 18 are preferably stored in roll form, with their respective zipper profiles 30 interengaged with one another. The reel 36 which supports the roll of zipper stock preferably has a core diameter of at least about 12 in. This diameter is larger than that of known commercially available spools of zipper stock which were used in development of the apparatus. The larger core diameter is believed to provide a significant advantage with respect to maintaining linearity of the zipper stock after it has been joined to the film web and longitudinally folded.

During the development of the invention, wrinkling of the package film has presented problems at various stages of the operation of the apparatus. The wrinkling problems are somewhat complex due to the three dimensional manipulation of the film which is required to form the longitudinal fold and to wrap the film about the product and seal it. Certain aspects of the wrinkling problems were traced to a tendency of the fastener strips 16 and 18 to assume nonlinear configurations after attachment to the film web 20, and the nonlinearity of the fastener strips 16 and 18 in turn was found to be related to the core diameter of the roll of strip material used to supply the operation. The provision of a relatively large core diameter has been found to alleviate some aspects of the wrinkling problems. Further aspects of the wrinkling problems are discussed below.

The reel of zipper stock 36 has a horizontal axis and in the illustrated embodiment is positioned to one side of the apparatus 12 for attaching the fastener material, supported on a free-standing support frame 38. The zipper stock advances from the reel through a dancer roller assembly 40 comprising a pair of, freely rotating rollers defining a gap therebetween for passage of the zipper stock, supported for rotation at the end of a pivotable, L-shaped lever arm 42 which is pivotally supported on the reel support frame 38 and biased downward to take up slack and maintain substantially uniform tension on the zipper stock as it is drawn from the reel 36 to the apparatus 12 for attaching it to the web 20.

The zipper stock next proceeds through a divider assembly 43 comprising a pair of guide rollers 44 and 46 and over a further guide roller 48, then is engaged by a divider roller 49 which continuously disengages the zipper profiles 30 from one another and separates the respective zipper strips 16 and 18. The strips are then twisted 90° about their longitudinal axes into a parallel configuration, spaced from one another, with their base surfaces 28 being substantially coplanar. In this configuration, the strips are drawn over a roller 50 and pass through a slotted guide 52 which locates and aligns them precisely relative to the web of film 20.

Immediately downstream from the guide 52, the zipper strips and adjacent longitudinal regions of the web of film 20 are heated by a pair of copper-beryllium heat sealing bars 54 which raise the temperature of the strips and film regions without contact therewith, through radiant and convective heat transfer. Pressure is then applied to the flange portions 56 of the strips and the adjacent heated regions of the film web by a plurality of pressure wheels 58, 60, 62 and 64 to fuse or adhere the strips 16 and 18 to the film. To provide the required heat transfer to the film and fastener strip material while enabling relatively high speeds of operation to be maintained, the heat sealing bars are relatively long, preferably about 12 in. in length, and are maintained in close proximity to the film and fastener strips, preferably separated therefrom by less than 0.1 in.

Figure 7:
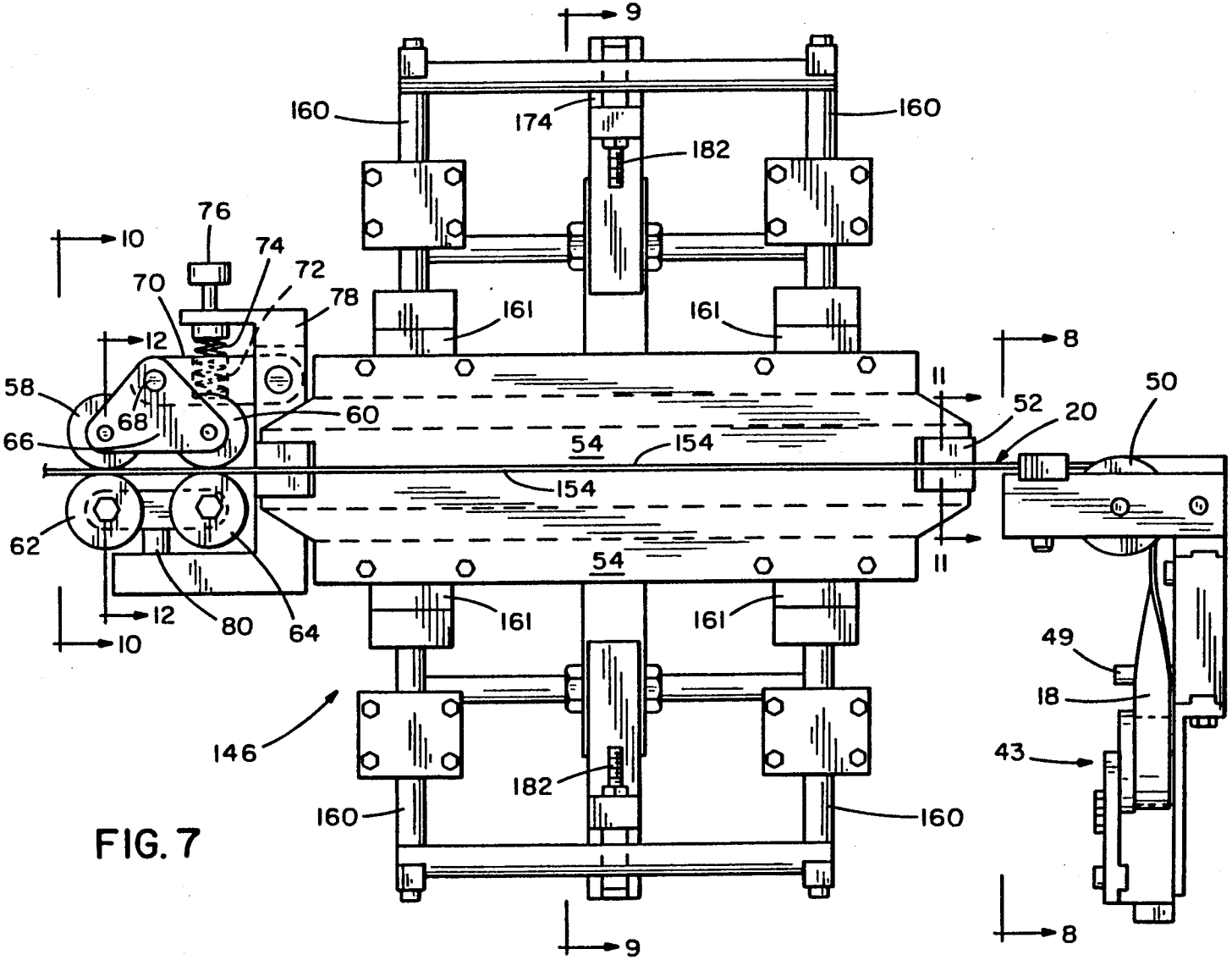
FIG. 7 is a side view of a sealing subassembly of the apparatus of FIG. 5.
Figure 8:
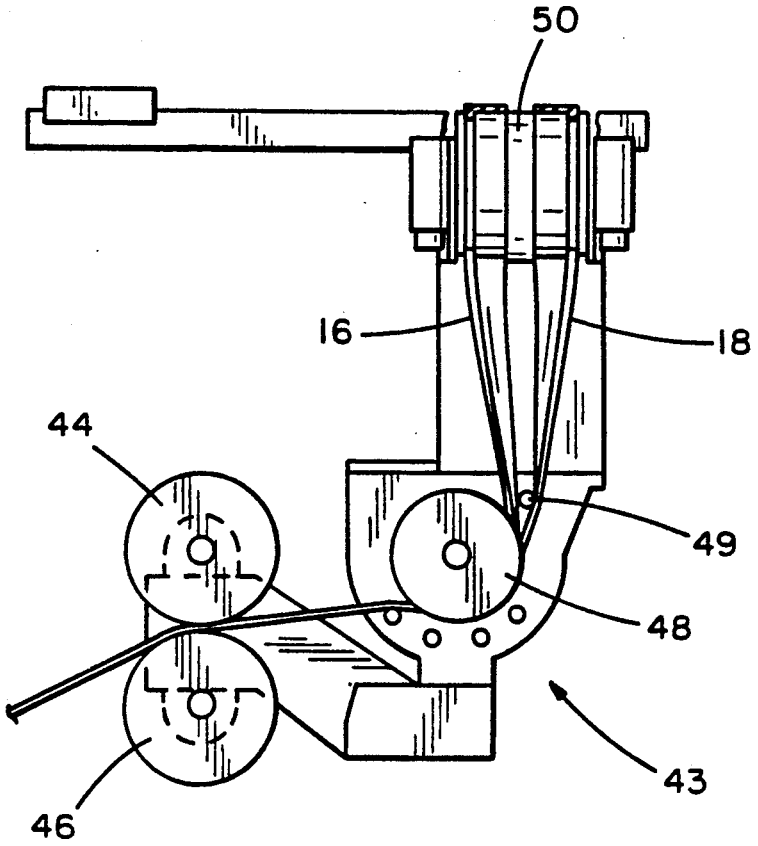
FIG. 8 is a sectional view taken substantially along line 8—8 of FIG. 7.
Figure 10:
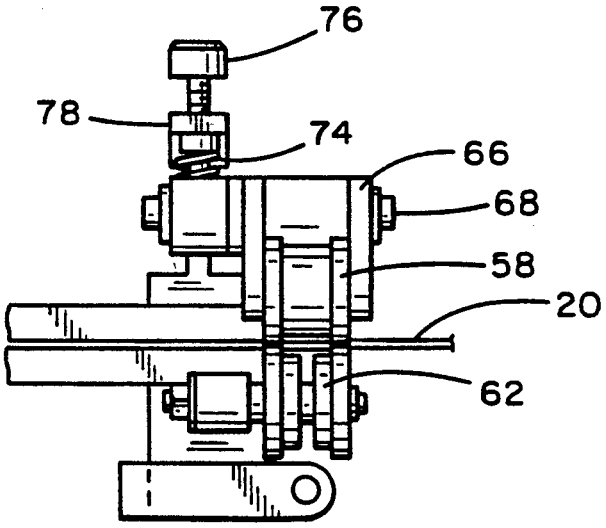
FIG. 10 is a sectional view taken substantially along line 10—10 of FIG. 7.

As shown in FIG. 7, the preferred pressure wheels comprise an upper wheel assembly having a pair of wheels 58 and 60 disposed fore and aft, and a lower wheel assembly comprising wheels 62 and 64 opposing the pressure applied by the upper wheels. It is desirable that the upper wheels 58 and 60 apply approximately equal pressure, and to this end they are mounted on a support 66 which is pivotable about a pin 68 disposed at a point such that a plane perpendicular to the web through the pin would be located between and approximately equidistant from the respective wheels. The pin 68 is fixed to the end of a pivoting lever arm 70 having a recess 72 formed therein for receiving the lower end of a coil spring 74, which is loaded in compression to bias the lever arm 70 downward, thereby forcing the upper wheels 58 and 60 downward. To enable adjustment of the biasing force, the upper end of the coil spring 74 is engaged by the lower end of an adjustment screw assembly 76 which is supported in a threaded bore in a frame member 78. The lower wheels 62 and 64 are mounted for rotation on a fixed, T-shaped support 80 extending upward from a lower frame member.

Figure 12:
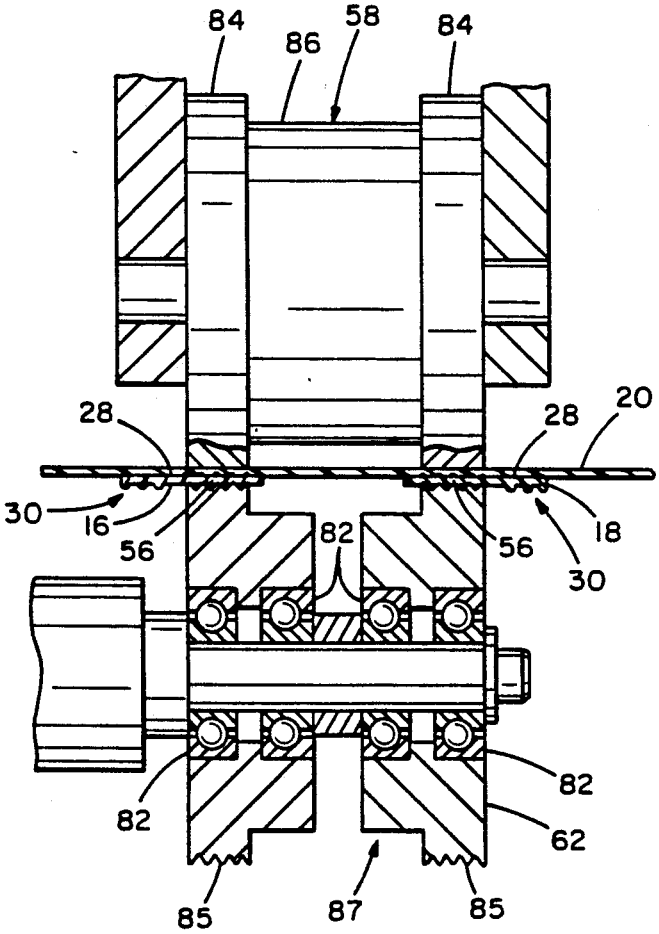
FIG. 12 is a sectional view taken substantially along line 12—12 of FIG. 7.
Figure 14:
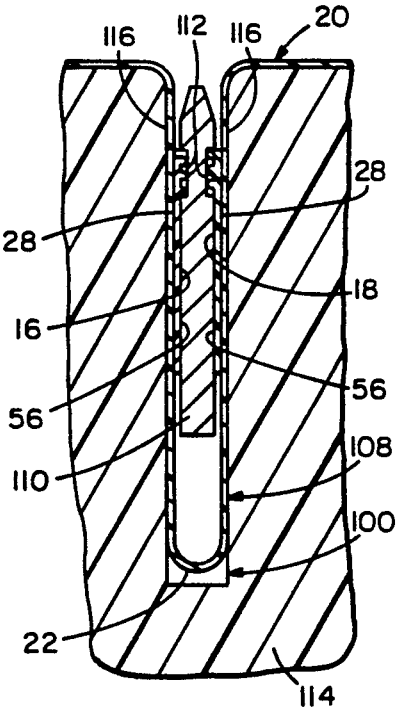
FIG. 14 is a sectional view taken substantially along line 14—14 of FIG. 5.

Suitable bearings are provided for each of the respective upper and lower wheels. The bearings 82 for one of the lower wheels are illustrated in FIG. 12. As also shown in FIG. 12, each of the upper and lower wheels has surfaces 84 and 85 of relatively large diameter on either side for engaging the flange areas 56 of the fastener strip material and the corresponding abutting areas of the film web, with areas 86, 87 of smaller diameter therebetween to avoid engagement of the fastener strips and web between the flange areas 56. The large diameter surfaces 85 of the lower wheel which engage the fastener strip flanges are knurled, whereas the corresponding surfaces 84 on the upper wheel are relatively smooth.

Figure 5:
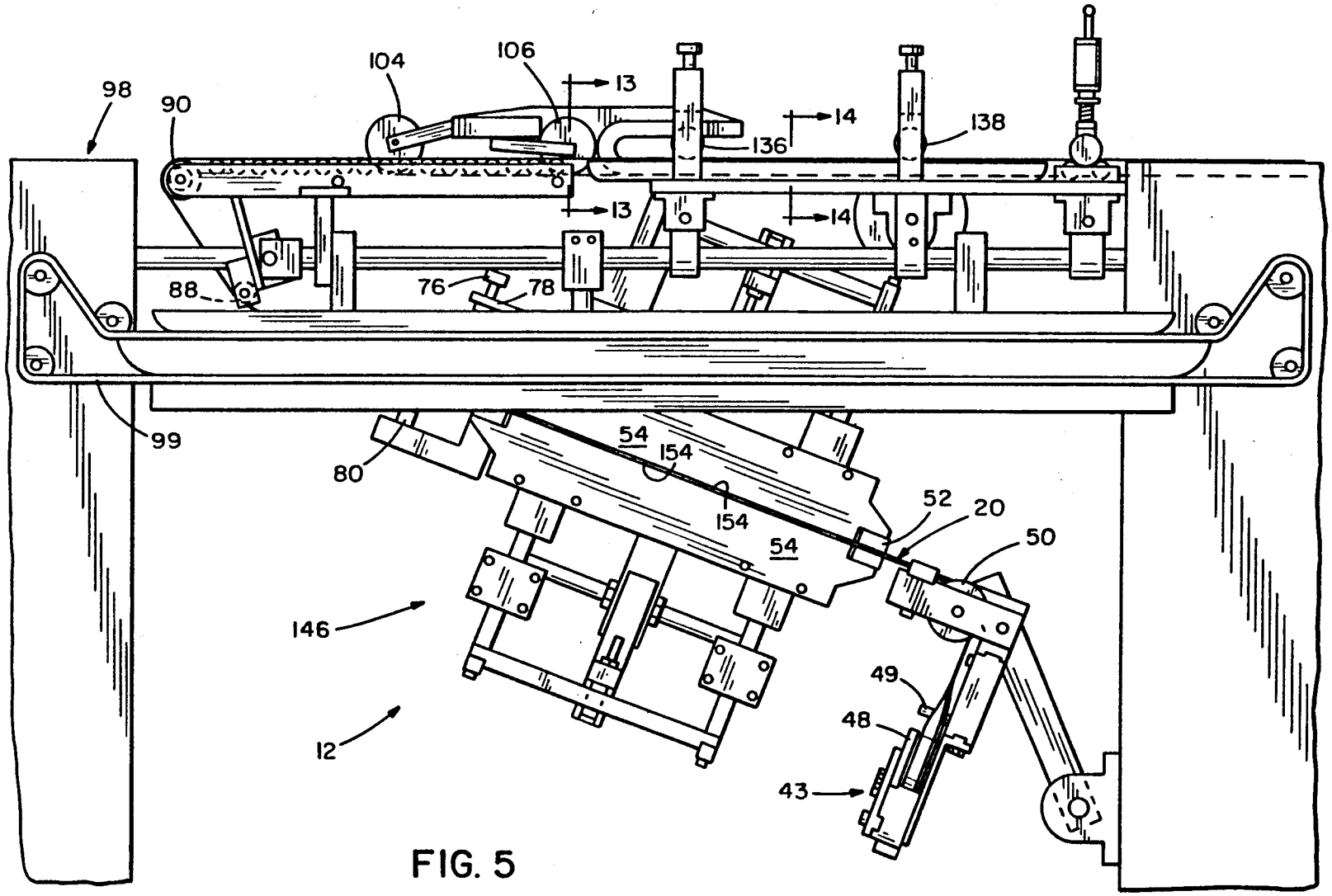
FIG. 5 is a side elevational view of apparatus for applying a continuous strip of reclosable fastener material to a web of package material and providing a longitudinal fold in the resulting assembly in the apparatus of FIG. 1.
Figure 6:
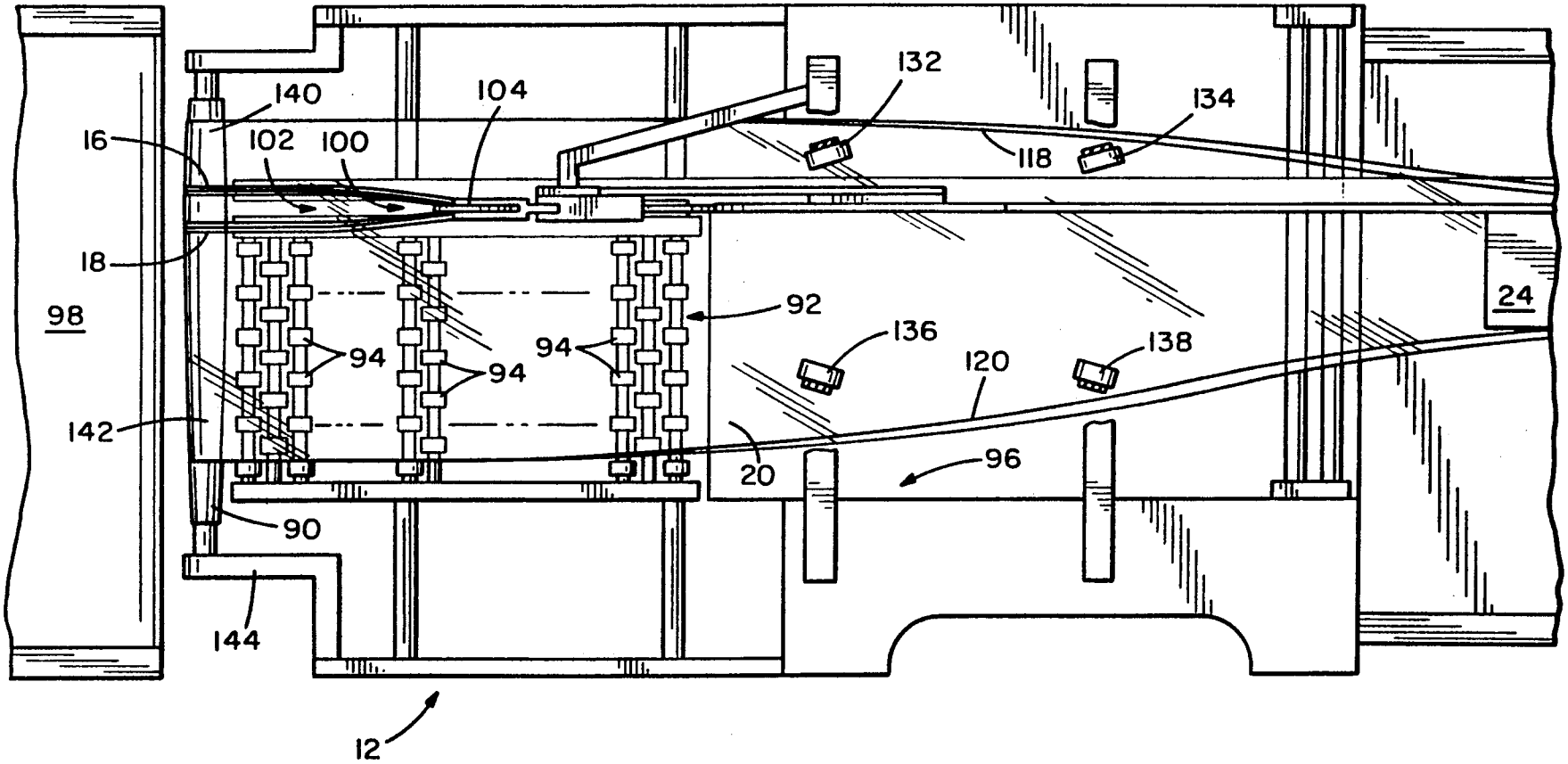
FIG. 6 is a plan view of the apparatus of FIG. 5.

After passing between the upper and lower pressure wheels 58, 60, 62 and 64, the film with the zipper strips attached thereto is drawn upward over a guide roller 88 disposed a short distance downstream from the wheels, and subsequently over a roller 90 at the input end of the apparatus. As the film passes over the roller 90, it changes direction, from traveling upward and to the left (with reference to FIG. 5) at an angle of about 30° to the vertical, to a horizontal orientation, traveling from the input end of the apparatus 12 toward the output end.

The film 20 is supported adjacent the input end of the apparatus 12 by a roller conveyor 92 having a plurality of rollers 94 rotatable about horizontal axes engaging the lower surface of the film 20 in rolling contact. Immediately downstream from the roller conveyor there is provided a substantially planar, smooth surface 96 over which the film slides with the product 24 supported thereon.

The product 24 is loaded onto the film 20 at the input end of the apparatus by a horizontal belt conveyor 98 which extends to the input end of the apparatus 12 so as to load product 24 at regularly spaced intervals corresponding to the longitudinal dimension of the pouch blanks on the web 20, and which may be driven in timed relation to the web 20, with a timing chain or belt 99 connecting the respective drives.

A longitudinal slot or groove 100 is provided adjacent the roller conveyor 92 and support surface 96 for receiving a fold 108 of the film web containing the fastener strips 16 and 18. The longitudinal region 102 of the film web disposed between the strips of fastener material 16 and 18 is forced downward by a vertically oriented wheel 104 which engages the film in rolling contact. The fastener strips 16 and 18 are drawn downward into the groove as well. As the web continues to travel along the apparatus 12, the fold 108 is maintained by a second wheel 106 and a stationary vertical plate 110 which maintains sliding contact with the film and fastener strips. The plate 110 has grooves 112 therein on each side to receive the zipper profiles 30 in sliding contact, and maintain the fastener strips 16 and 18 in alignment with one another so that their interengageable profiles 30 will mate properly. As the fold 108 travels along the plate 110, its outer surfaces are engaged by interior surfaces 116 of a shoe 114. Immediately downstream from the end of the plate 110 the interior surfaces 116 of the shoe are convergent so as to exert inward pressure on the outer surfaces of the folded portion of the web as the web is drawn forward, thereby effecting interengagement of the fastener profiles 30, i.e., closure of the zipper.

The web then passes from the apparatus 12 for attaching the fastener profiles and folding the web to the apparatus 14 for carrying out the further steps required to form, fill and seal the pouches 26.

The fastener profiles remain interengaged, and the opposite longitudinal edges 118 and 120 of the web are wrapped upward over the product to meet generally centrally of the upper surface of the product, and are sealed together to form a longitudinal fin seal 122 on the upper surface of the pouch being formed. The fin seal is formed by conventional sealing apparatus 124.

Figures 2, 3, 4:
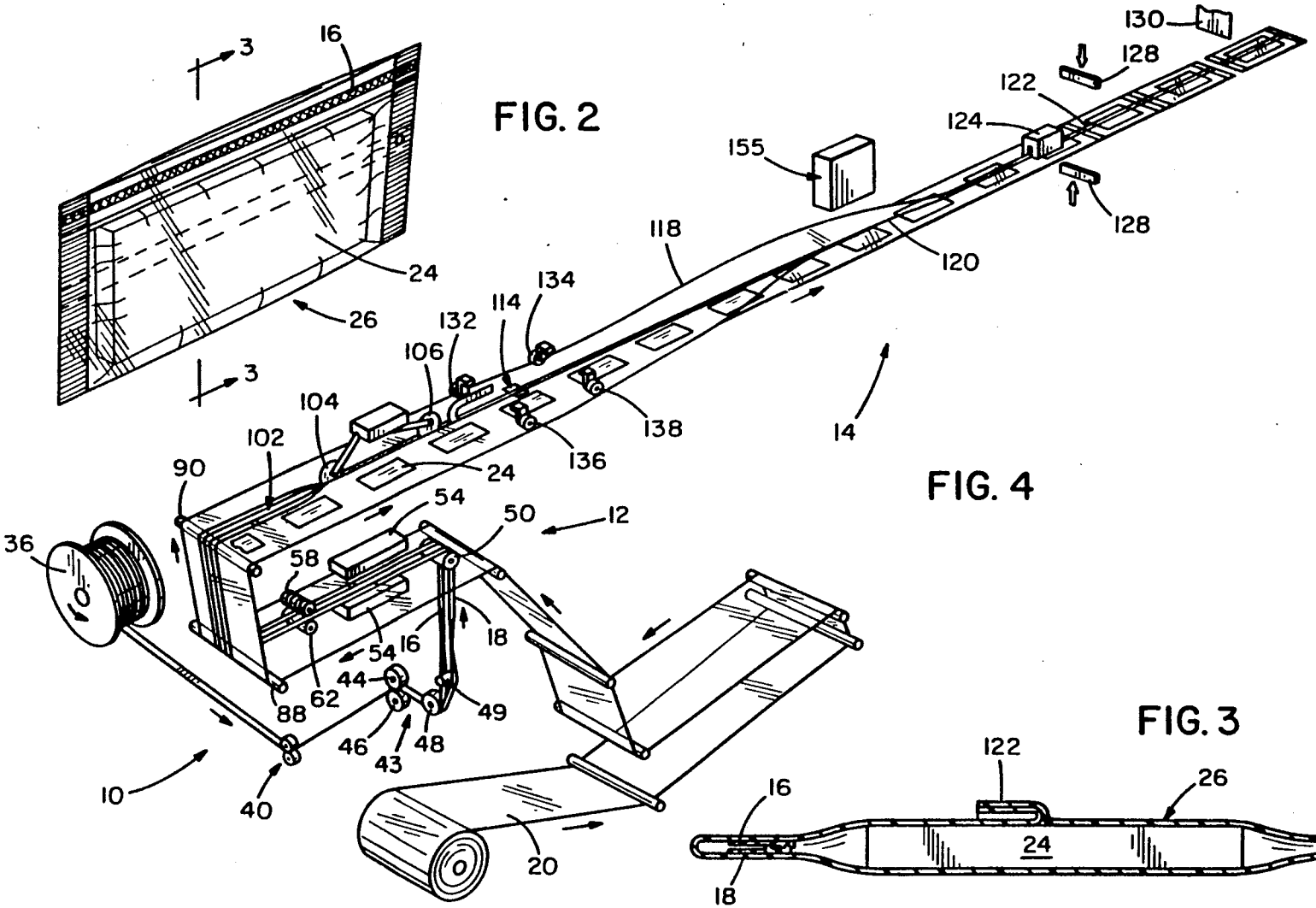
FIG. 2 is a perspective view of a pouch formed, fill and sealed by the apparatus of FIG. 1.
FIG. 3 is a sectional view taken substantially along line 3—3 in FIG. 2.
FIG. 4 is a diagrammatic view illustrating the forming, filling and sealing of a pouch by the apparatus of FIG. 1.

Apparatus 126 (FIG. 1) is provided for evacuating air or backflushing the packages in accordance with known techniques. Cross-seals are formed by sealing bars 128, and the finished package is cut from the web by a transverse cutting implement 130 (FIG. 4).

As mentioned above, one of the problems which is addressed by the apparatus is the control of wrinkles in the web, particularly in the areas adjacent to the locations at which the longitudinal fold is formed and the fastener profiles are brought into interengagement with one another. In these areas, it is desirable that the film be maintained essentially flat and wrinkle-free on each side of the fold.

To this end, control over wrinkling is achieved through the use of a combination of features, including the employment of a tapered surface on the roller 90; the provision of means for canting the roller 90 slightly; and the use of a plurality of friction wheels 132, 134, 136 and 138 which engage the upper surface of the web 20.

The surface of the roller 90 comprises a pair of frustoconical surfaces 140 and 142 which meet at the location corresponding to the area 102 between the strips of fastener material 16, 18, such that the diameter of the roller 90 is at its maximum at this location. The angle of taper is relatively small, e.g., about 5°.

To provide adjustability for the roller 90, at least one end of the roller is adjustable with at least one degree of freedom of movement for adjustment of the roller position. In the illustrated embodiment, the righthand end of the roller as shown in FIG. is supported on a pivotable arm 144 and is positioned at an elevation slightly below that of the lefthand end of the roller. This has the effect of compensating partially for variations in web tension due to the asymmetrical configuration given the web by the addition of the fastener profiles 16, 18, the formation of the longitudinal fold 108, and the wrapping of the web upward about the product 24.

Further control over wrinkling and web tension is provided by the friction wheels 132, 134, 136 and 138, each of which is positioned so as to provide outward tension adjacent one of the edges 118 and 120 of the web as it travels forward. The friction wheels engage the upper surface of the web 20 so as to be rotated by the forward movement of the web, and are turned slightly outward so that their rotation urges the web surface engaged by each wheel outward.

Figure 9:
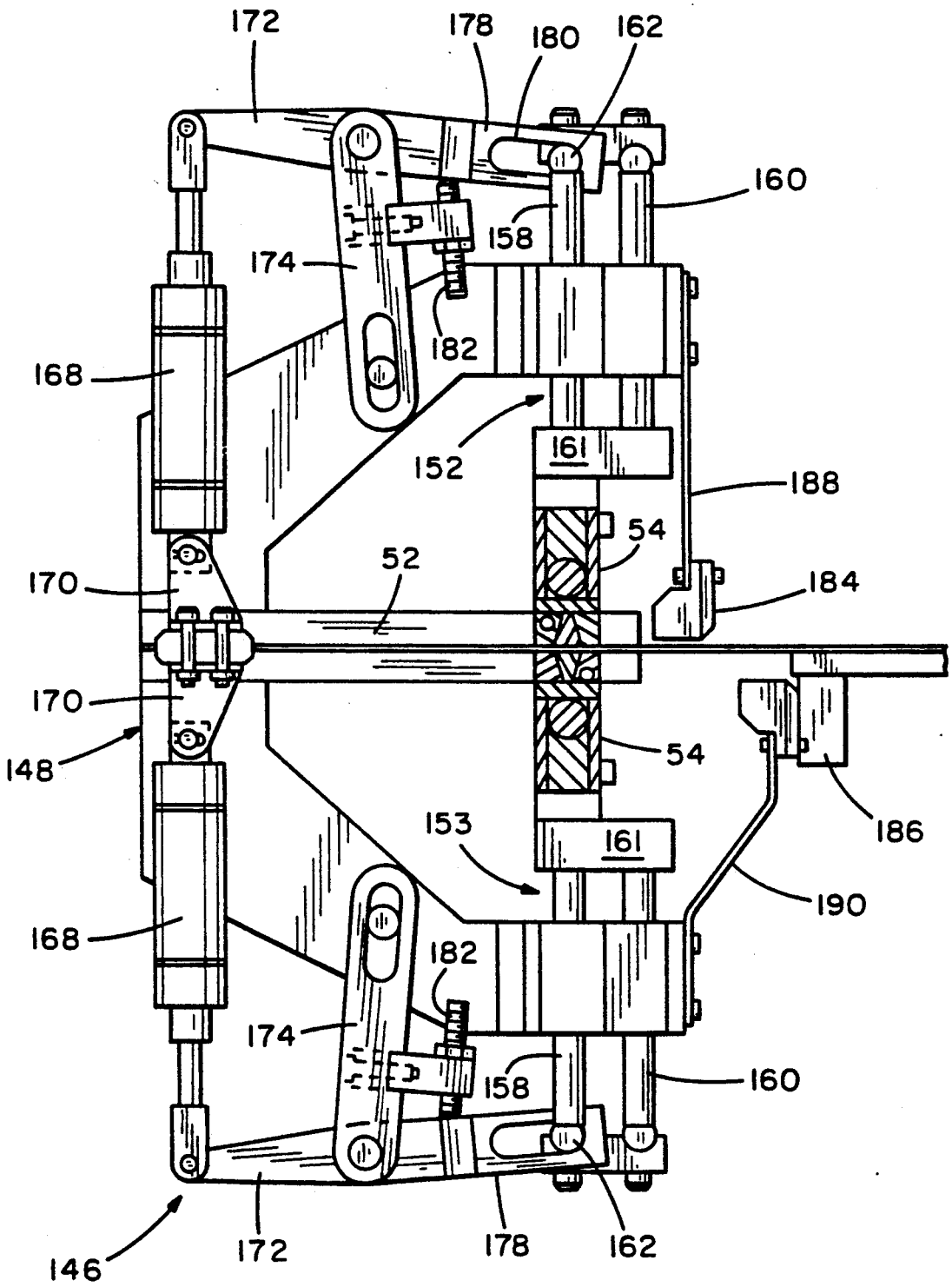
FIG. 9 is a sectional view taken substantially along line 9—9 of FIG. 7.
Figure 11:
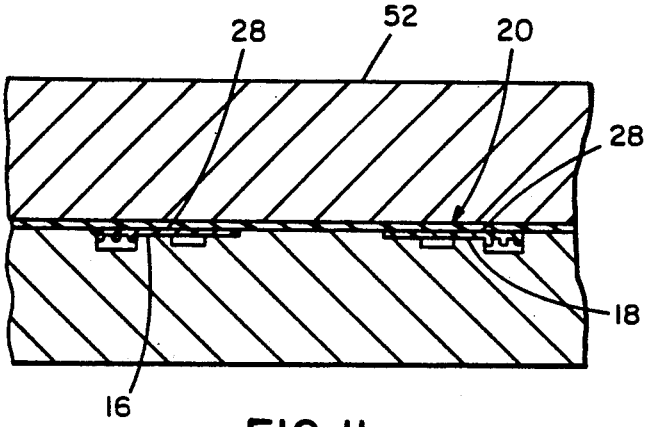
FIG. 11 is a sectional view taken substantially along line 11—11 of FIG. 7.
Figure 13:
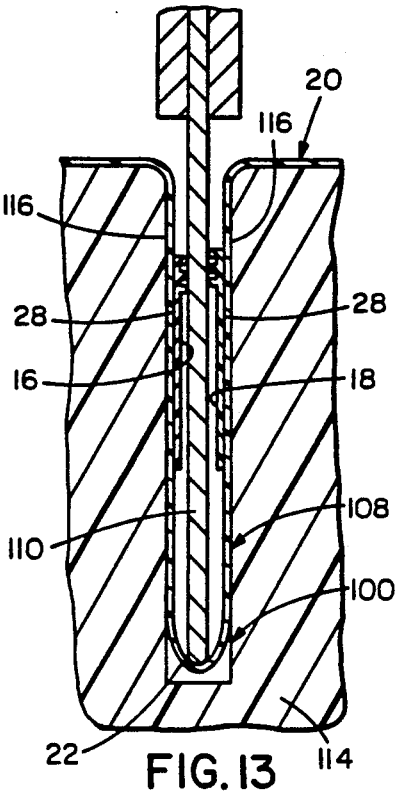
FIG. 13 is a sectional view taken substantially along line 13—13 of FIG. 5.

To avoid damage to web 20 or fastener strips 16, 18 during interruptions of operations, means are provided to withdraw the heat seal bars 54 from proximity with the web 20 in response to stoppage of web travel. The heat seal bars 54 are part of an assembly 146 which, as illustrated in FIGS. 7 and 9, comprises a frame 148 fixedly supported on the frame of the apparatus 12, and reciprocating support members 152, 153 for supporting the heat seal bars for movement between a closed position in which their heating surfaces 154 are in close proximity to the web and to one another, and an open position providing sufficient space between the heat seal bars and the web 20 to avoid overheating of the web 20 during stoppage. FIGS. 7 and 9 illustrate the heat seal bars 54 in the closed position.

The apparatus 12 includes a control system 155 which preheats the heat seal bars 54 during start-up, prior to initiation of web travel, with the seal bars 54 maintained in the open position. This enables the fastener profiles 16 and 18 to be properly sealed to the web 20 substantially along the entire length of web passing between the heat seal bars 54, rather than having substantial lengths of the fastener strips 16, 18 inadequately attached at the start of operations due to insufficient heat while the seal bars are being heated to their operating temperature.

As shown in FIG. 9, the reciprocating support members 152 and 153 each comprise pairs of parallel rods 158, 160 which are slidably disposed through bores in the fixed frame 148 at each end of each of the seal bars and attached by mounting blocks 161 to the seal bars 54.

Shifting of the heat seal bars 54 between their open and closed positions is effected through the use of hydraulic or pneumatic cylinders 168 which are located generally centrally of the elongated apparatus. Each cylinder has one end pivotally connected to a respective lug 170 on the frame, and has its opposite end pivotally connected to a lever arm 172. The fulcrum for the lever arm is provided by an adjustable link 174 which is fixed in place while the apparatus operates. Each of the lever arms 172 preferably has a bifurcated construction, with an elongated member 178 at each end having an elongated slot 180 therein engaging an elongated bar 162 on an associated one of the reciprocating support members 152. A threaded rod or other suitable adjustable stop 182 is provided to determine the innermost position of each heat seal bar 54 in the closed position.

Upper and lower air knives 184 and 186 (shown in FIG. 9 only) effect flow of relatively low temperature air between the heat seal bars 54 and the film 20 during interruption of operation and during start-up when the heat seal bars 54 are in their open position. The air knives are supported on respective upper and lower brackets 188, 190 bolted to the frame 148 of the heat seal bar assembly, and connected to shop air or another suitable source of ambient air. Thus, the air knives, in combination with the opening of the seal bars during interruption of web travel, prevent overheating of the web and fastener strips.

From the foregoing, it should be apparent that the invention provides an improved method and apparatus for forming, filling and sealing reclosable packaging. The invention is not limited to the embodiment described above or to any single embodiment, but rather is pointed out in the following claims.

What is claimed is:

1. A method of packaging a food item in a reclosable pouch on form-fill-seal apparatus comprising:

advancing a continuous web of package material;

providing a pair of continuous narrow interengageable strips of fastener material in interengaged relation with one another;

disengaging said continuous narrow interengageable strips of fastener material from one another to form separate continuous lengths of fastener material and supporting them in parallel with one another;

joining said pair of continuous narrow strips of fastener material to said web of package material at a joining station, with said strips of fastener material oriented longitudinally relative to said web at said joining station;

folding said web of package material longitudinally at a folding station so as to bring together said strips of fastener material;

effecting interengagement of said strips of fastener material;

maintaining a portion of said web in a substantially flat, generally horizontal orientation for receiving said food item at a loading station;

placing said food item onto said portion of said web at said loading station;

wrapping side portions of said web upward around said food product to bring opposite edge portions thereof together;

sealing said opposite edge portions to each other to form a longitudinal fin seal;

cross-sealing said web adjacent the leading end of said food item;

cross-sealing said web adjacent the trailing end of said food item;

transversely cutting said web adjacent the leading end of the food item; and transversely cutting said web adjacent the trailing end of said food item.

2. A method in accordance with claim 1 further comprising deflecting said web between said joining station and said folding station with the deflection of said web varying across its width.

3. A method in accordance with claim 2 wherein deflection of said web is maximized adjacent said strips of fastener material.

4. A method in accordance with claim 1 wherein said web of package material comprises a laminated polymeric material which includes an outer layer comprising an ethylene vinyl acetate copolymer.

5. A method in accordance with claim 4 wherein the step of joining said fastener material to said package material comprises heating a predetermined region of said web of package material to melt a coating thereon, said coating then being effective to bond said fastener material to said package material.

6. A method in accordance with claim 1 wherein joining of said fastener material to said package material is effected through the use of a pre-applied hot melt adhesive on said fastener material.

7. A method in accordance with claim 1 wherein the step of continuously joining said fastener material to said package material comprises melting pre-applied ethylene vinyl acetate coatings on both said package material and said fastener material while applying pressure to force said fastener material against said package material 8. Apparatus for attaching fastener material to package material and forming, filling and sealing reclosable pouches in line, comprising:

a frame;

means for supporting a web of package material;

means for advancing said web of package material;

means for supporting a continuous length of fastener material comprising first and second interengageable strips, said first and second interengageable strips being initially interengaged with one another;

means for disengaging said first and second interengageable strips from one another to form separate continuous lengths of fastener material and supporting them in parallel with one another;

means for joining said fastener material to said package material at a joining station;

means for providing a longitudinal fold in said web of package material so as to being together said first and second interengageable strips of said fastener material and place said strips of fastener material within the longitudinal fold in said package material;

means to effect interengagement of said first and second interengageable strips;

means for maintaining a portion of said web in a substantially flat, horizontal configuration for receiving product;

means for placing product onto said portion of said web;

means for wrapping said first web upward around said product to bring opposite edges thereof together;

means for sealing said opposite edges to each other to form a fin seal;

means for cross-sealing said first web to provide transverse seals for the pouches being formed; and means for transversely cutting said package web to separate the pouches from one another.

9. Apparatus in accordance with claim 8 further comprising means for controlling wrinkling of said web.

10. Apparatus in accordance with claim 9 wherein said means for controlling wrinkling comprises a roller.

11. Apparatus in accordance with claim 10 wherein said roller has a nonuniform diameter.

12. Apparatus in accordance with claim 10 wherein said roller is canted so that its axis is not perpendicular to the direction of travel of said web.

13. Apparatus in accordance with claim 8 wherein said means for joining said fastener material to said package material comprises means for heating flange portions of said fastener material and corresponding portions of said package web, and means for applying pressure to force said flange portions against said corresponding portions of said web.

14. Apparatus in accordance with claim 13 wherein said means for heating comprises a pair of elongated heating elements oriented parallel to the direction of travel of said web at said joining station, said elongated heating elements being at least about 12 in. in length and being spaced from said web and said fastener material by a narrow gap during operation, and being effective to heat said flange portions of said fastener material and corresponding portions of said web by radiant heat transfer.

15. Apparatus in accordance with claim 14 further comprising means to move said heating elements away from said fastener material and said web upon interruption of advancement of said web.

16. Apparatus in accordance with claim 15 further comprising a pair of air knives for effecting air flow over said fastener material and said web upon interruption of advancement of said web.

17. Apparatus in accordance with claim 13 wherein said mean for applying pressure comprises first and second rollers which are biased toward one another.

* * * * *